US007872660B2

(12) United States Patent
Zeng et al.

(10) Patent No.: US 7,872,660 B2
(45) Date of Patent: Jan. 18, 2011

(54) ELECTRO-WETTING-ON-DIELECTRIC PRINTING

(75) Inventors: Jun Zeng, Corvallis, OR (US); Haggai Karlinski, Ramat Chen (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/390,662

(22) Filed: Feb. 23, 2009

(65) Prior Publication Data

US 2010/0214388 A1 Aug. 26, 2010

(51) Int. Cl.
*B41J 2/39* (2006.01)
*B41J 2/41* (2006.01)

(52) U.S. Cl. ..... 347/111; 347/112

(58) Field of Classification Search ..... 347/111, 347/112

See application file for complete search history.

(56) References Cited

U.S. PATENT DOCUMENTS 3,687,072 A * 8/1972 Pym ..... 101/153
4,220,958 A 9/1980 Crowley
2007/0137509 A1 6/2007 Fork
2008/0132428 A1 6/2008 Cox et al.

FOREIGN PATENT DOCUMENTS

EP 1798606 A1 6/2007

OTHER PUBLICATIONS

Zeng, Jun et al.; "Principles of Droplet Electrohydrodynamics for Lab-on-a-Chip"; paper; 2004; 265-277; The Royal Society of Chemistry.

* cited by examiner

*Primary Examiner*—Huan H Tran

(57) ABSTRACT

An electro-wetting-on-dielectric printing system includes a drum and an electrode array disposed on a surface of the drum, which is made up of individually addressable electrodes and an ink-phobic coating overlaying the electrodes. Electrically charging a portion of the electrodes allows ink to adhere to a portion of the ink-phobic coating in proximity to the charged electrodes. A method for electro-wetting-on-dielectric printing includes selectively charging individually addressable electrodes within an electrode array, and passing the electrode array through an ink bath, wherein ink adheres areas proximate to charged electrodes to form an image. The image is then transferred to the substrate.

19 Claims, 10 Drawing Sheets

ELECTRO-WETTING-ON-DIELECTRIC PRINTING

BACKGROUND

Printing involves the transfer of ink onto a substrate to form an image on the substrate surface. Ideally, a printing system would be compatible with a wide variety of inks, including water-based, oil-based, and high solid content inks. Further, it is desired that the printing system be digitally reconfigurable and have high print speeds.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1A:
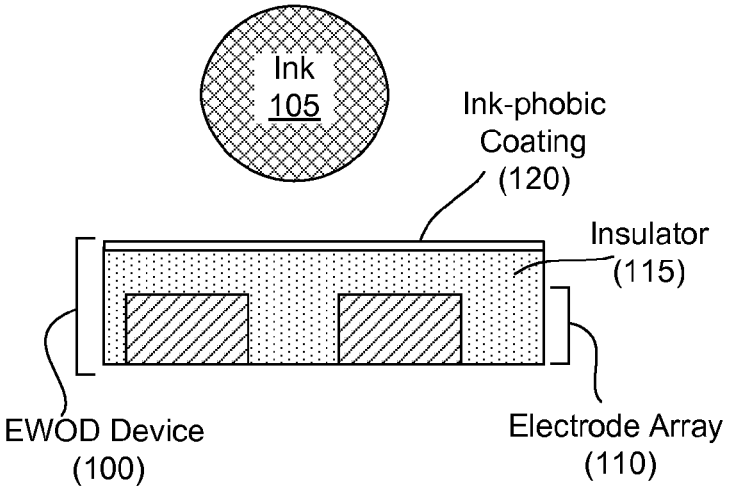
FIGS. 1A-1C illustrate the operational principles of one illustrative embodiment of an Electro-Wetting-On-Dielectric (EWOD) device, according to one illustrative embodiment of principles described herein.

Inkjet based print engines have several limitations which restrict the speed at which they can be operated. For example, drop placement errors and aerosol generation limit current web speed of inkjet based print engines, for example, to about two meters per second. In contrast a typical analog press may run at much higher speed, for example, eight meters per second. Additionally, inkjet inks include high water or solvent content which may require complicated and costly drying systems. Inks with high solid content may result in jettability problems.

Printing systems that use photoconductive imaging drums also have a number of limitations. For example, imaging performed with light emitting diodes (LEDs) may have reliability issues. Where a laser is used for photoimaging, the drum width can be limited due to optical constraints. In some printers, print speed is slowed down because colors are printed sequentially. Further, some printing methodologies are limited to very specific ink formulations, which can result in very expensive inks and consumables.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

In one illustrative embodiment, an Electro-Wetting-On-Dielectric (EWOD) print engine helps solve the above problems by using an EWOD digital contact printing method. The contact printing approach helps eliminate drop placement error and reduce aerosol problems. By using electro-wetting technology a wider selection of ink formulations can be used which can simplify drying requirements and reduce the cost of ink and consumables. The digital electrode array used in the EWOD print engine has an inkjet-like digitized architecture which allows the EWOD digital print engine to be used as a drop-in replacement for existing inkjet print engines. Much like the thermal inkjet print engines, the EWOD printer can be configured to separate the print data into different channels according to color. Each channel can then be distributed to a dedicated EWOD print engine. By including multiple EWOD print engines (one for each color), the color printing operation can be performed in parallel.

According to one illustrative embodiment, a two dimensional array of electrodes is used to generate the image. These electrodes are individually addressable. Over these electrodes a thin insulating layer is formed. On top of the insulating layer, a very thin layer of ink-phobic material is placed. The ink-phobic properties of this thin layer can be altered by charging the underlying electrodes. For example, the electrodes can be charged such that the desired ink is locally attracted to portions of the surface which are in proximity to the charged electrodes. The electrode array is then brought into contact with the desired ink, which forms an image on the surface of the electrode array which corresponds to the charged portions of the electrode array.

Figure 1B:
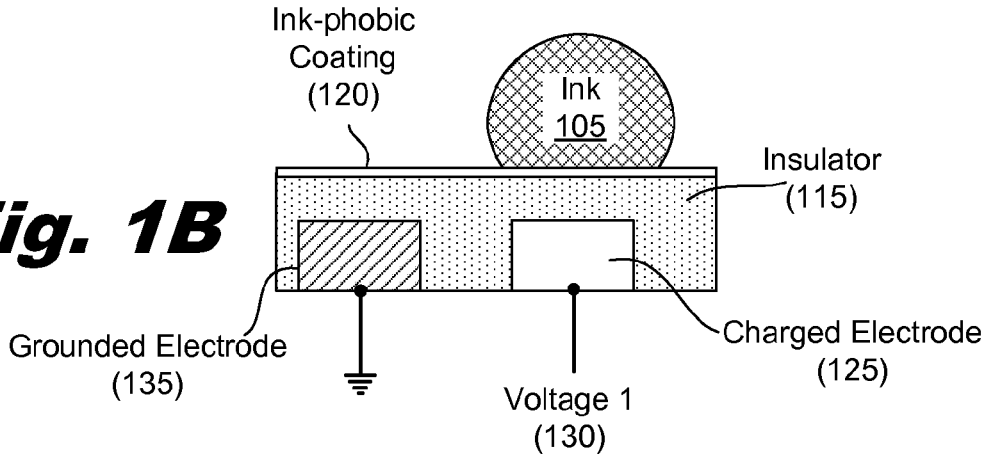
Figure 1C:
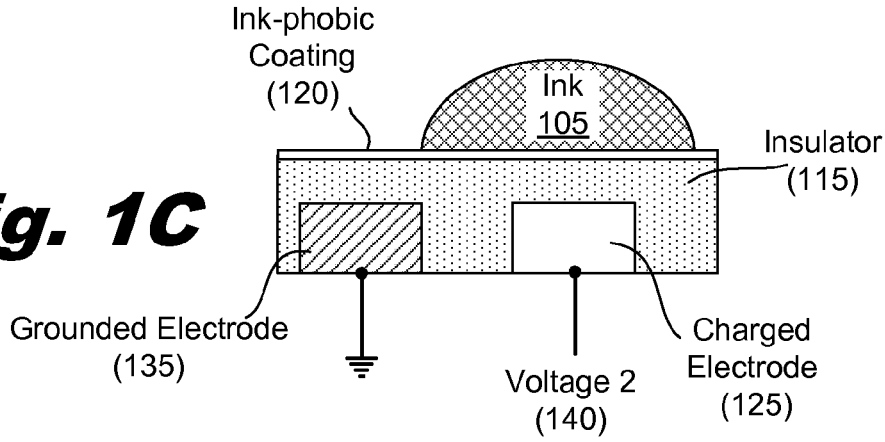

FIGS. 1A-1C are cross-sectional diagrams which illustrate the operational principles of one illustrative embodiment of an EWOD device (100). The EWOD device (100) includes an array of individually addressable electrodes (110). These electrodes are separated and covered by an insulating material (115). An ink-phobic coating may be deposited (120) on top of the insulating material (115). According to one illustrative embodiment, this ink-phobic coating (120) may be a polytrerafluoroethylene or polytetrafluoroethene (PTFE) synthetic fluoropolymer. These fluorocarbons create a very electronegative surface due to the influence of the fluorine atoms attached to the exterior of the carbon backbone. By way of example and not limitation, PTFE material may be spin coated onto the insulating surface and produce a layer that has a thickness of tens of nanometers. The resulting PTFE surface is both hydro-phobic and lipo-phobic. Consequently, during the printing process this PTFE surface will repel ink and other water or oil based fluids. In some circumstances, it may be desirable to micro-pattern the ink-phobic surface to increase or decrease its ink repellant characteristics. For example, micro-patterning PTFE can increase its ink repellant characteristics through the "lotus effect." The "lotus effect" refers to the super-hydro-phobic characteristics of the lotus leaves which are produced by the micro-patterned surface of the leaves. The micro-patterning of the PTFE can include, for example, a number of bumps or columns which are a few microns in height and a few microns in width. However, when an underlying electrode is positively charged, the electronegative characteristics of the ink-phobic surface can be reduced or reversed.

As shown in FIG. 1B, the electrode array (110) can be energized with a voltage 1 (130) to create a charged electrode (125). This charged electrode (125) alters surface characteristics of the ink-phobic coating (120) to make it ink-philic in the immediate vicinity of the charged electrode (125). The droplet of ink is then attracted to the locally ink-philic portion of the ink-phobic coating (120). Other electrodes in the electrode array (110) can be grounded or float at voltage potentials which are not high enough to alter the ink-phobic character of the coating (120).

FIG. 1C shows a higher voltage 2 (140) being applied to the charged electrode (125). As can be shown by FIG. 1C, the shape of the ink droplet changes as it is increasingly attracted to the portion of the surface which is in proximity to the charged electrode (125).

Figure 2:
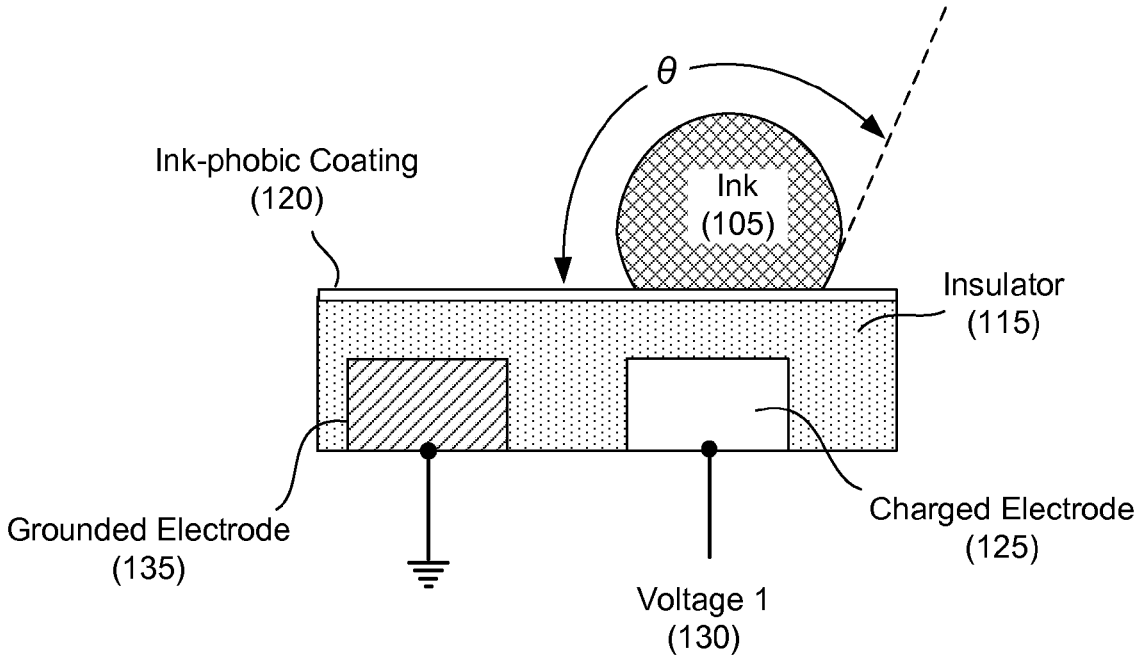
FIG. 2 illustrates an ink droplet resting over a charged electrode, according to one illustrative embodiment of principles described herein.

One method of measuring the attractive forces that exist between a fluid and a surface is measuring a contact angle θ of a droplet resting on the surface. FIG. 2 shows the contact angle θ of the ink droplet. In the illustrative embodiment shown in FIG. 2, the contact angle θ is approximately equal to 117 degrees. Generally surfaces that are classified as hydrophobic have higher contact angles and hydrophilic surfaces have lower contact angles. By relating the applied electrowetting on dielectric (EWOD) force to the contact angle θ, the relationship between an electrode voltage and the fluid contact angle can be determined.

The equation for the electro-wetting on dielectric (EWOD) force is given in Eq. 1.

$$F_{EWOD} = \frac{\varepsilon_i V^2}{8d}\left(\frac{1}{\left(1+\frac{\varepsilon_i}{\varepsilon_d}\frac{D}{2d}\right)^2} - \frac{1}{\left(1+\frac{\varepsilon_i}{\varepsilon_a}\frac{D}{2d}\right)^2}\right) \quad \text{Eq. 1}$$

Where:

$F_{EWOD}$=electro-wetting on dielectric (EWOD) force

V=electrode charge voltage d=insulator thickness

D=drop size

ϵ=electric permittivity; subscript i is insulator; d is droplet, a is air.

Eq. 2 relates $F_{EWOD}$ to the change in contact angle that the $F_{EWOD}$ produces.

$$\Delta\theta = \theta_0 - a\cos\left(\cos\theta_0 + \frac{F_{EWOD}}{\gamma}\right) \quad \text{Eq. 2}$$

Where:

$\theta_0$=static contact angle

Δθ=contact angle reduction

γ=surface tension

When the ink is an electrolyte fluid, the ink can be considered a floating conductor. The EWOD force ($F_{EWOD}$) can then be simplified as shown in Eq. 3.

$$F_{EWOD} = \frac{\varepsilon_i V^2}{8d}\left(-\frac{1}{\left(1+\frac{\varepsilon_i}{\varepsilon_a}\frac{D}{2d}\right)^2}\right) \quad \text{Eq. 3}$$

If it is further assumed that the drop size is much larger than the insulator thickness, Eq. 3 can be further simplified to the form of Eq. 4.

$$F_{EWOD} = \frac{\varepsilon_i V^2}{8d} \quad \text{Eq. 4}$$

Consequently, the EWOD force ($F_{EWOD}$) is proportional to the permittivity of the insulator ($\epsilon_i$) and square of the applied voltage (V), but inversely proportional to the thickness of the insulating layer (115). As a higher voltage (V) is applied to the electrode, the EWOD force increases and the contact angle is reduced. Design parameters include the desired geometry of the EWOD elements and voltage to be applied to the electrodes. The EWOD structure should exert enough EWOD force to overcome the ink-phobic characteristics of the material and attract the ink to local surface area above a charged electrode. The ink should be attracted to this local area with enough force that the ink is not dislodged by the force of gravity, centrifugal force, or accelerations of the printing apparatus.

As shown above, the EWOD force generates a contact angle reduction due to the disparity of the electric field in the area under the droplet and the area exposed to air. As long as the electrical properties of the ink are different from air (which is almost always the case), the EWOD operation can be functional.

One method of testing the attractive EWOD forces is to show that the EWOD force is sufficient to overcome surface tension which holds a droplet together. If the EWOD force can pull one droplet apart into two or more smaller droplets, the EWOD force will be sufficient to perform the ink manipulation tasks required in most printing processes.

Figure 3A:
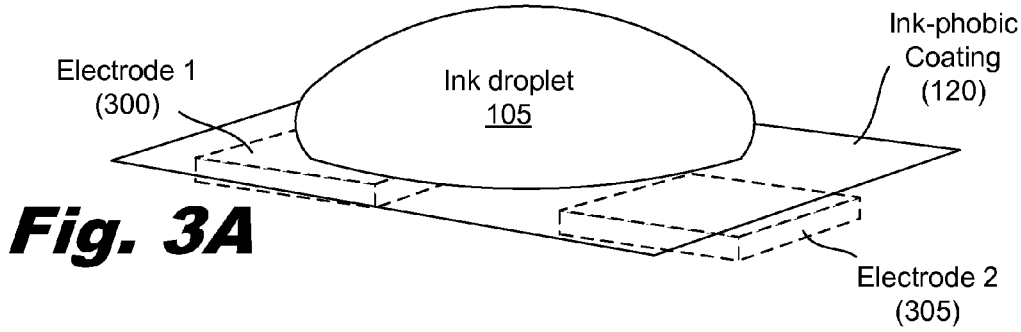
FIGS. 3A-3D are illustrations of a drop of ink placed between two electrodes, according to one illustrative embodiment of principles described herein.

FIGS. 3A-3D are illustrations of a drop of ink (105) which is placed between two electrodes (300, 305). According to one illustrative embodiment, FIG. 3A shows one micro-liter ink droplet (105) resting on an ink-phobic surface (120). The ink droplet (105) has a contact angle of approximately 117 degrees. At this point, the electrodes (300, 305) have not yet been charged and the ink droplet (105) could be easily dislodged by a change in orientation or acceleration.

Figure 3B:
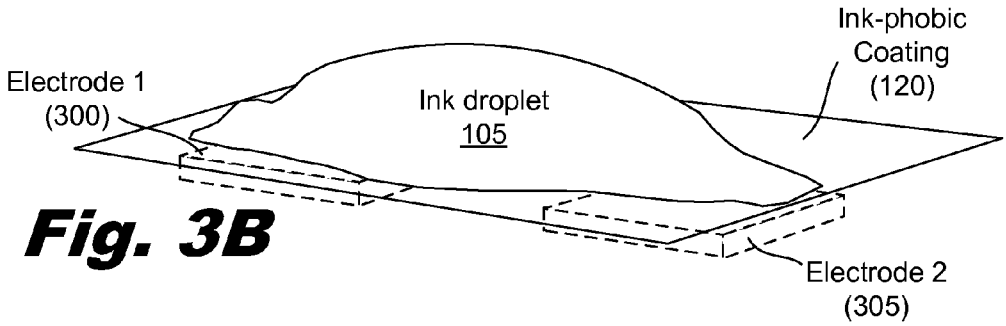
Figure 3C:
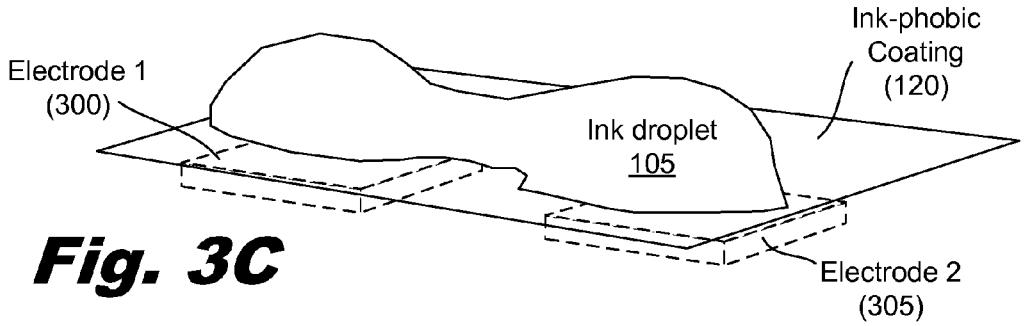
Figure 3D:
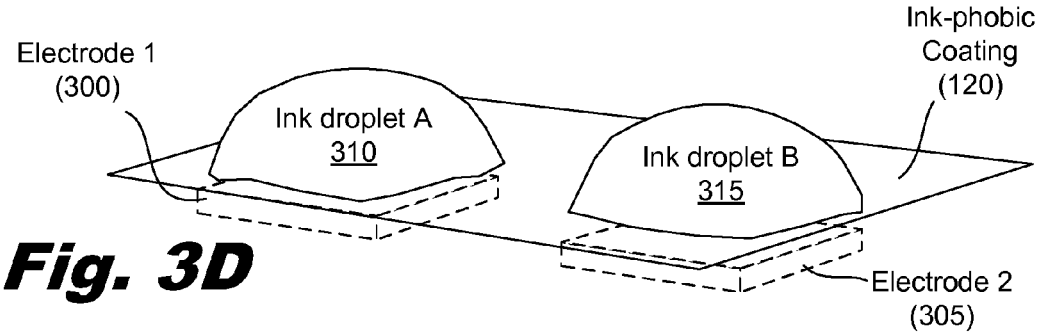

FIGS. 3B-3D show the effects of applying 70 Volts to the two electrodes (300, 305). Initially, the ink droplet (105) begins to wet the local surfaces above the charged electrodes, as shown in FIG. 3B. The contact angle of the ink droplet (105) in these areas has been reduced to about 20 to 30 degrees. FIG. 3C shows the droplet (105) a short time later as it thins in the center into a dumbbell shape. FIG. 3D shows the original ink droplet (105) separated into two smaller droplets (310, 315) over the electrodes. This example helps demonstrate that moderate voltage can produce enough EWOD force to make an EWOD printing device viable.

Figure 4A:
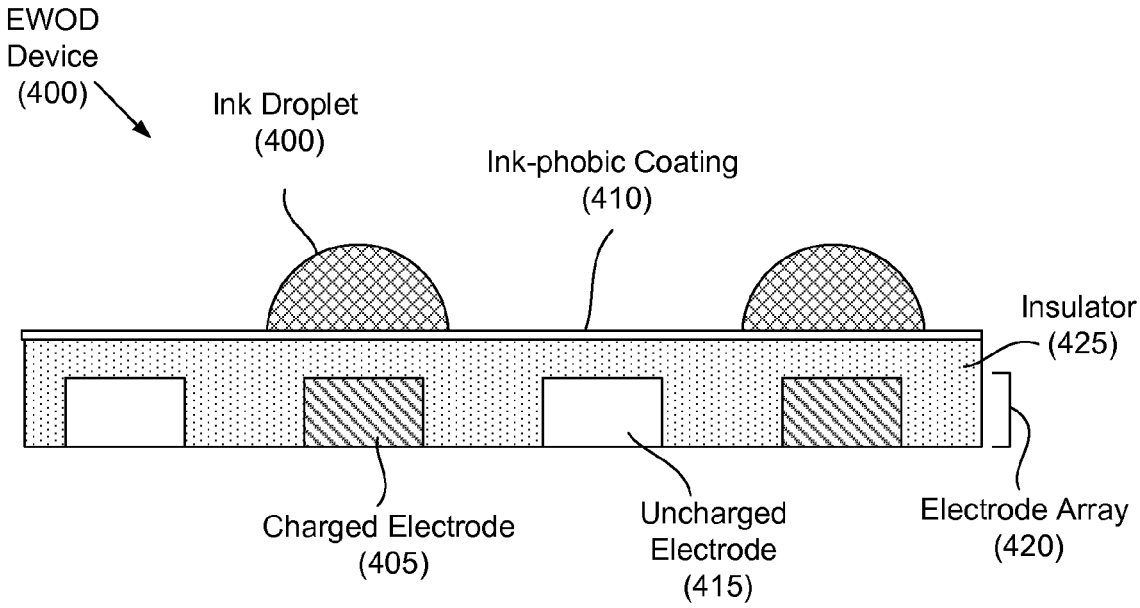
FIGS. 4A and 4B are illustrations which show a cross-section and a perspective view, respectively, of an EWOD device which incorporates an electrode array of individually addressed electrodes, according to one illustrative embodiment of principles described herein.
Figure 4B:
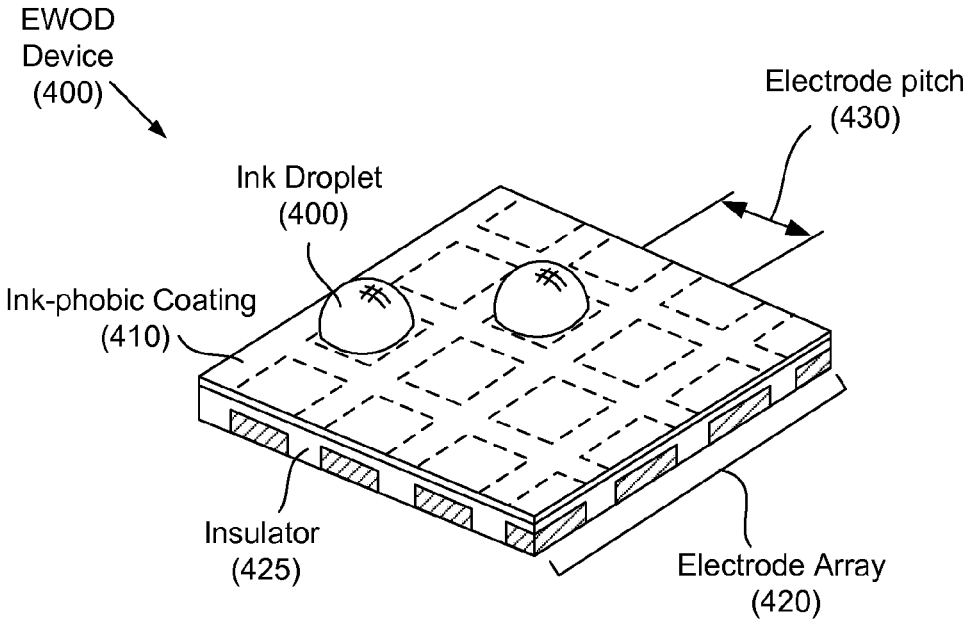

FIGS. 4A and 4B are illustrations which show a cross-section and a perspective view, respectively, of an EWOD device (400) which incorporates an electrode array (420) of individually addressed electrodes (405, 415). According to one illustrative embodiment, the electrode pitch (430) could correspond to desired dot resolution. For example, if a dot resolution of 1200 pixels per inch is desired, then the electrode pitch would be selected such that there would be 1200 individually addressable electrodes per inch across the array. For purposes of illustration, the electrodes have been greatly enlarged.

Further, the electrodes need not have a fill factor that approaches 100%. According to one illustrative embodiment, the electrodes fill only a small portion of the overall surface area. However, the electrodes are configured to attract enough ink over their local surface area so that the ink will cover the desired area when applied to the substrate.

According to one illustrative embodiment, the electrode voltage can be varied to produce variations in the ink droplet sizes, contact angles, and surface energy of the impression drum. For example, the electrode voltage may be adjusted to compensate for various inks, substrate types, and/or to match the surface energy of a substrate or transfer drum. In one illustrative embodiment, the electrode voltage may be varied spatially across the array. Electrodes with higher charges pick up more ink and electrodes with lower charges pick up less ink. Consequently, the areas of the substrate which receive ink from the electrodes with higher charges may have greater optical density than areas which contact electrodes with lower charges may have a lower optical density.

The electrodes may be directly addressable from the bottom of the array. For example, the bottom portion of the electrode could be exposed. Contact could then be made with the exposed bottom surface of the electrode to transfer charges to the electrode. Additionally or alternatively, the electrodes may be addressable via traces which run through the EWOD device.

The electrodes may be arranged in a variety of patterns including the orthogonal array as shown in FIG. 4B, staggered rows, hexagonal packing, or other configurations. Further, the electrodes need not have a square upper surface. For example, the electrodes could have a rectangular, circular, hexagonal, elliptical, or other upper surface.

The ink-phobic coating (410) could be made from a variety of materials. If it is desirable to make an EWOD device which is functional with both water and oil based inks, the ink-phobic surface must be both hydro-phobic and lipo-phobic. This could be accomplished by using a PTFE or silicone based ink-phobic layer. As discussed above micro-patterning of the surface could also alter its characteristics. Where the EWOD device designed only for water based inks, the surface need only be hydro-phobic. Similarly, if the EWOD device is designed only for use with oil-based inks, the surface need only be lipo-phobic.

According to one illustrative embodiment, the EWOD device (400) could be rolled into a cylinder which rotates about its longitudinal axis. In some illustrative embodiments, this allows the EWOD device to be used in a continuous flow printing process.

Figure 5:
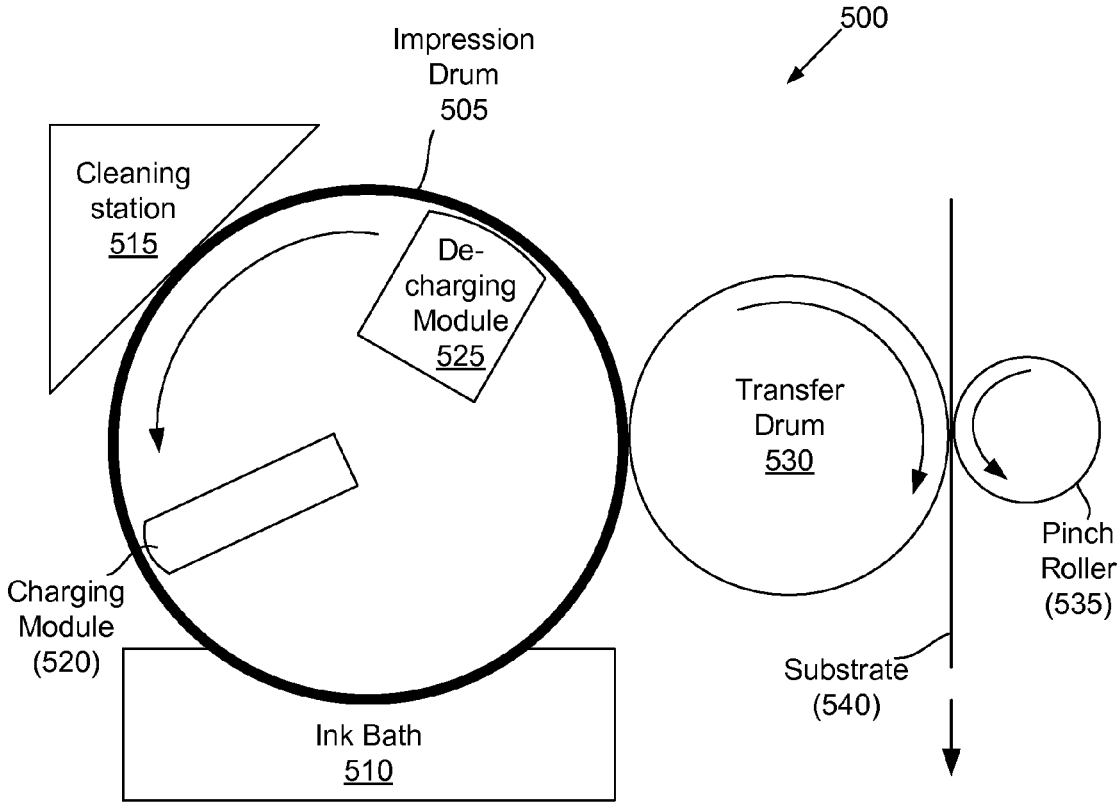
FIG. 5 is an illustrative EWOD printing system which incorporates an impression drum having an EWOD electrode array on its outer surface, according to one illustrative embodiment of principles described herein.

FIG. 5 is an illustrative EWOD printing system (500) which incorporates an impression drum (505) which has an EWOD electrode array on its outer surface. According to one illustrative embodiment, the electrodes can be individually addressed from the inside of the impression drum (505). A charging module (520) charges the desired electrodes on the outer surface of the impression drum (505). According to one illustrative embodiment, the charging module (520) selectively transfers charge to each of the horizontal rows of the array as they passes by the charging module (520). The charging module could use a variety of methods for transferring charge to the electrodes. By way of example and not limitation, the charging module could transfer charge using photoelectric methods, direct contact methods, indirect contact methods, or ionization methods. The location and size of the charging module (520) can also be adjusted to achieve the transfer of the desired charges onto the electrodes.

The impression drum (505) continues to rotate and moves the surface past the charging module (520) and into the ink bath (510). In the ink bath (510), the local surfaces over the charged electrodes attract the ink, while the remaining portions of the ink-phobic surface repel the ink. Consequently, as the drum rotates out of the ink bath (510), an ink pattern is formed over the charged electrodes. This ink pattern is transferred onto the transfer drum (530). The substrate (540) is fed between the transfer drum (530) and the pinch roller (535). As the transfer drum (530) contacts the substrate (540) the image is transferred onto the substrate. Alternatively, the impression drum (505) may directly transfer the image to the substrate.

The impression drum (505) continues to rotate and brings the charged electrodes into contact with a de-charging module (525). The de-charging module (525) removes the charges from the electrodes, thereby returning the outer surface of the impression drum (505) to its original hydro-phobic or lipo-phobic state. The drum surface next passes through a cleaning station (515) which removes any excess ink from the surface. The cleaning station (515) may use a variety of methods to remove the ink from the surface. By way of example and not limitation, the cleaning station (515) may use an air knife, a wiper, a squeegee, a sponge roller, or other suitable device to remove the ink from the surface. The process described above is continuously repeated to produce sequential printed images.

The EWOD print engine described above may be configured to work with a wide variety of inks, including high viscosity inks. High viscosity inks have a number of advantages which include high quality color, high pigment loading, reduction/elimination of the need for drying, and compatibility with a wide range of substrates, in addition to potentially reduced cost. Additionally, the EWOD print engine can be configured to be drop-in replacement for existing inkjet print engines because of its inkjet-like digital architecture. The array of electrodes can be digitally addressed using the same data stream used to address an array of inkjet nozzles. Consequently, the EWOD print engine can utilize the existing digital front end, firmware, and finishing apparatus of many existing inkjet printing systems.

Figure 6:
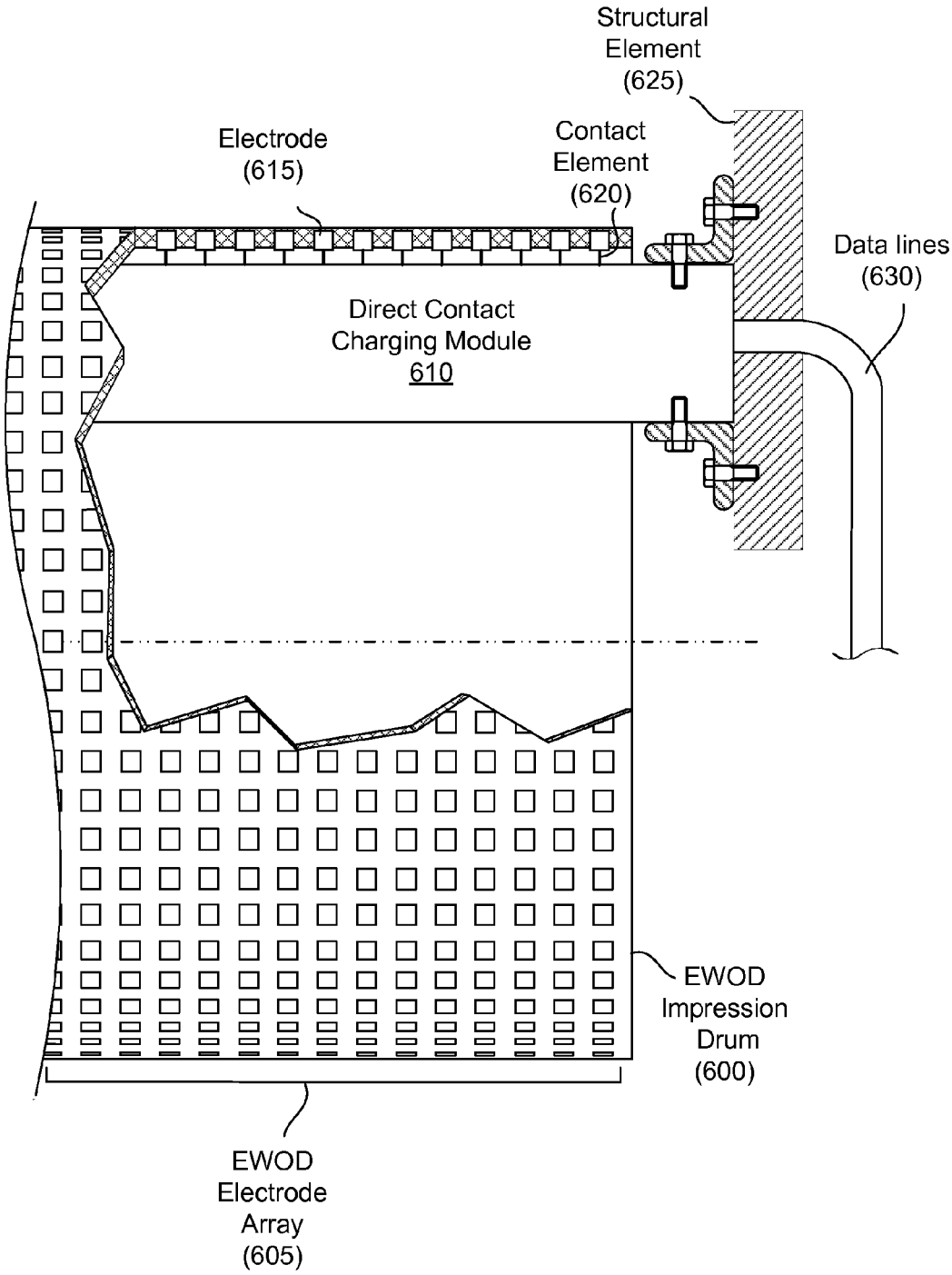
FIG. 6 is a partially cut-away view of an illustrative EWOD impression drum, according to one illustrative embodiment of principles described herein.

FIG. 6 is a partially cutaway view of an EWOD impression drum (600). As discussed above, an EWOD electrode array (605) covers the outer surface of the impression drum (600). In this illustrative embodiment, the individual electrodes within the electrode array (605) are accessed using a direct contact charging module (610). Each individual electrode in the array extends through the wall of the cylinder and has an exposed surface on the interior of the cylinder. As the impression drum (600) rotates, contact elements (620) sequentially connect to the electrodes passing by the charging module (610). The charging module (610) selectively activates the contact elements (620) which are configured to conduct an electrical charge to the desired electrodes. By way of example and not limitation, the contact elements may be teeth, wires, rollers or other suitable elements which provide accurate contact with electrodes that are very closely spaced.

One advantage of using a direct contact charging module (610) is that the charging module (610) does not have to rotate with the impression cylinder (600). Rather, the charging module (610) can be bolted securely in place and the impression drum can rotate about the charging module to sequentially present the electrode rows. The stationary nature of the charging module has the advantage that there is no requirement that high speed data be passed from the stationary portion of the printer into the rotating EWOD impression drum for distribution to the electrodes. Instead, the charging module remains stationary and is attached to a number of data lines (630). The charging module itself remains stationary and passes the data to the electrodes as they rotate past. At any given time, only one or a few rows of the electrodes are brought into contact with the contact element. Therefore, using a direct contact charging module requires much smaller data rates compared to an approach that addresses the electrode array simultaneously.

Figure 7A:
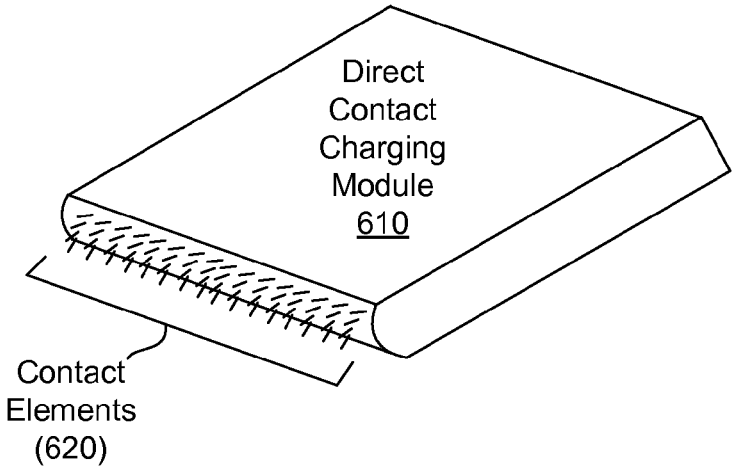
FIGS. 7A-7C are illustrative embodiments of a direct contact charging module, according to one illustrative embodiment of principles described herein.
Figure 7B:
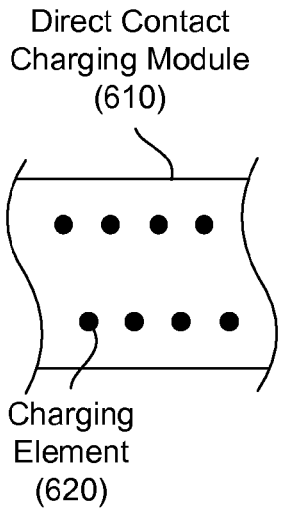
Figure 7C:
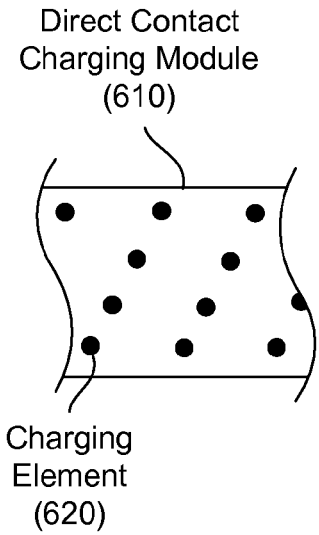

FIGS. 7A-7C are illustrative embodiments of a direct contact charging module (610) or charging brush. FIG. 7A shows a perspective view of a direct contact charging module (610) which includes a plurality of contact elements (620). Because the spacing of the electrodes is the same as the pixel pitch, there can be, for example, between 300 to 1200 electrodes per linear inch. The contact elements (620) contact each of the electrodes as they rotate past the charging module (610). The contact elements (620) are selectively energized so that the desired charge is transferred to the electrodes. To prevent the contact elements (620) from touching each other and for ease of manufacturing, the contact elements may be arranged in a variety of patterns and orientations. FIG. 7A shows the contact elements (620) emerging from the charging module (610) at a variety of angles. This provides increased distance between the tips of the contact elements (620) and decreases the likelihood that distortion would cause adjacent contact elements to touch each other.

FIG. 7B is an end view of one illustrative embodiment of a charging module (610) with a two dimensional array of contact elements (620). These contact elements (620) could be arranged in a variety of patterns including a pattern with staggered rows. The staggered rows allow for increased spacing between contact elements (620) in each row. The next row has contact elements that are aligned between the contact elements in the previous row, thereby allowing electrode arrays with high linear densities to be precisely charged. FIG. 7C shows one illustrative embodiment of a charging module (610) with four rows of staggered contact elements (620).

A number of types of contact elements could be used. By way of example and not limitation, the contact elements could be electrically conductive wires, captured spheres, or disks. In some illustrative embodiments, the contact elements may be configured to transfer charge by transmission of electrical energy over an air gap without the requirement for physical contact between the contact element and the electrode.

Figure 8:
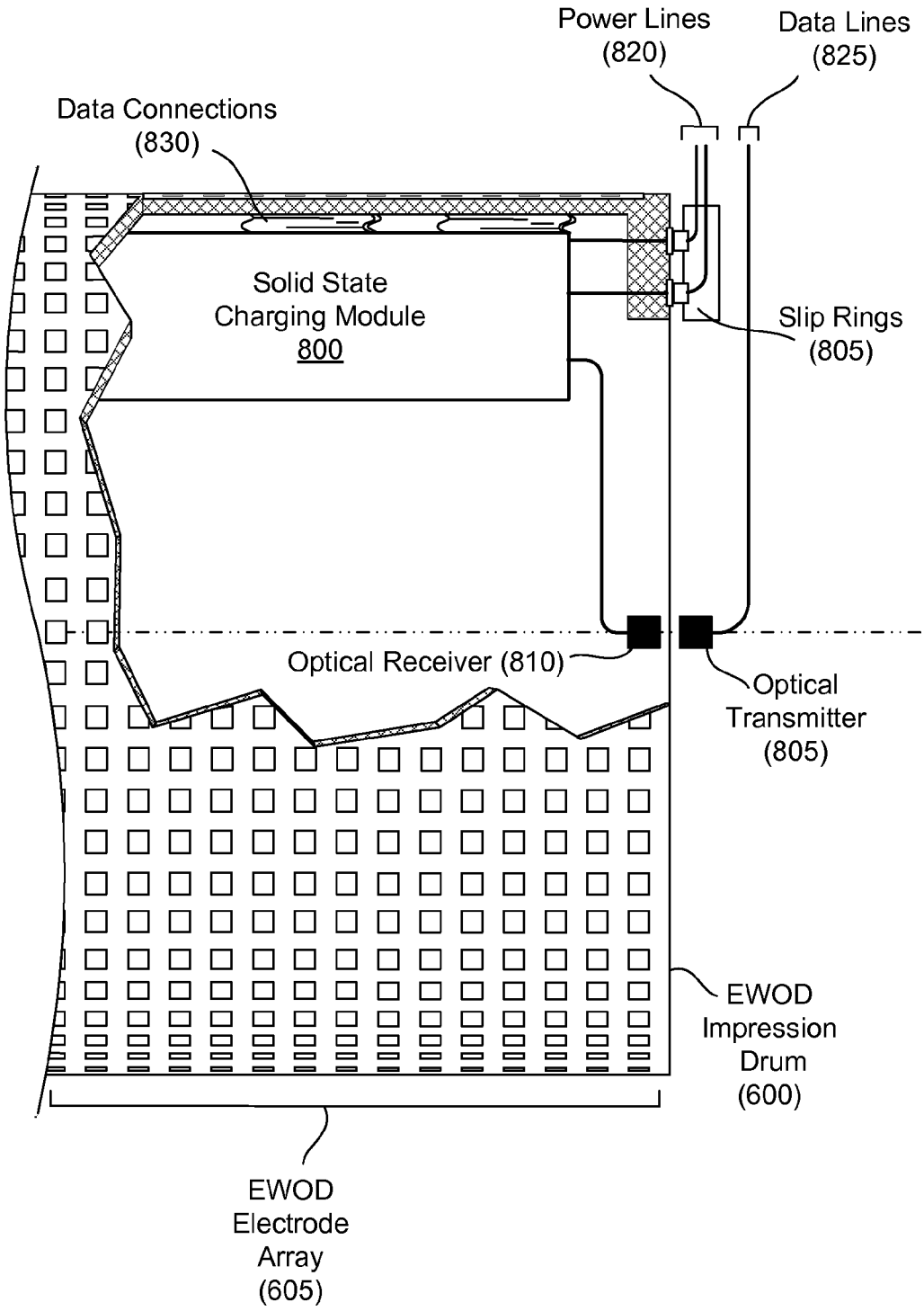
FIG. 8 is a partially cut-away view of an EWOD impression drum which incorporates a solid state charging module, according to one illustrative embodiment of principles described herein.

FIG. 8 is a partially cutaway view of an EWOD impression drum (600) which incorporates a solid state charging module (800). According to one illustrative embodiment, the solid state charging module (800) is attached to the impression drum (600) and rotates with it. The solid state charging module (800) receives electrical power through slip rings (805). Slip rings (805) have sufficient continuity to transfer power from the fixed power lines (820) across the rotating interface to the solid state charging module (800). However, the slip rings (805) may not be suitable for transferring high frequency data signals required to address the individual electrodes within the EWOD electrode array (605).

According to one illustrative embodiment, these high frequency data signals pass through stationary data lines (825) to an optical transmitter (805). The optical transmitter (805) converts these data signals into optical energy which is received by the optical receiver (810). In one embodiment, the optical transmitter and receiver (805, 810) may be aligned with the rotational axis of the drum. Consequently, the fixed transmitter (805) and rotating optical receiver (810) can remain aligned throughout the motion of the impression drum.

The optical transmitter (805) may use one or more optical frequencies to transmit the data. For example, the optical transmitter may use selected frequencies in the infrared, visible, or ultraviolet frequencies to transmit the data. Corresponding optical detectors within the optical receiver (810) receive the data and convert it back into electrical signals. These electrical signals are then passed to the solid state charging module (800).

The solid state charging module (800) uses a de-multiplexer or other addressing technology to decode the electrical signals into individual electrode addresses. The solid state charging module then charges the addressed electrodes by passing electrical energy through data connections (830) to the individual electrodes. According to one illustrative embodiment, the data connections are wired connections that connect from the solid state charging module (800) to the EWOD electrode array (605).

Figure 9:
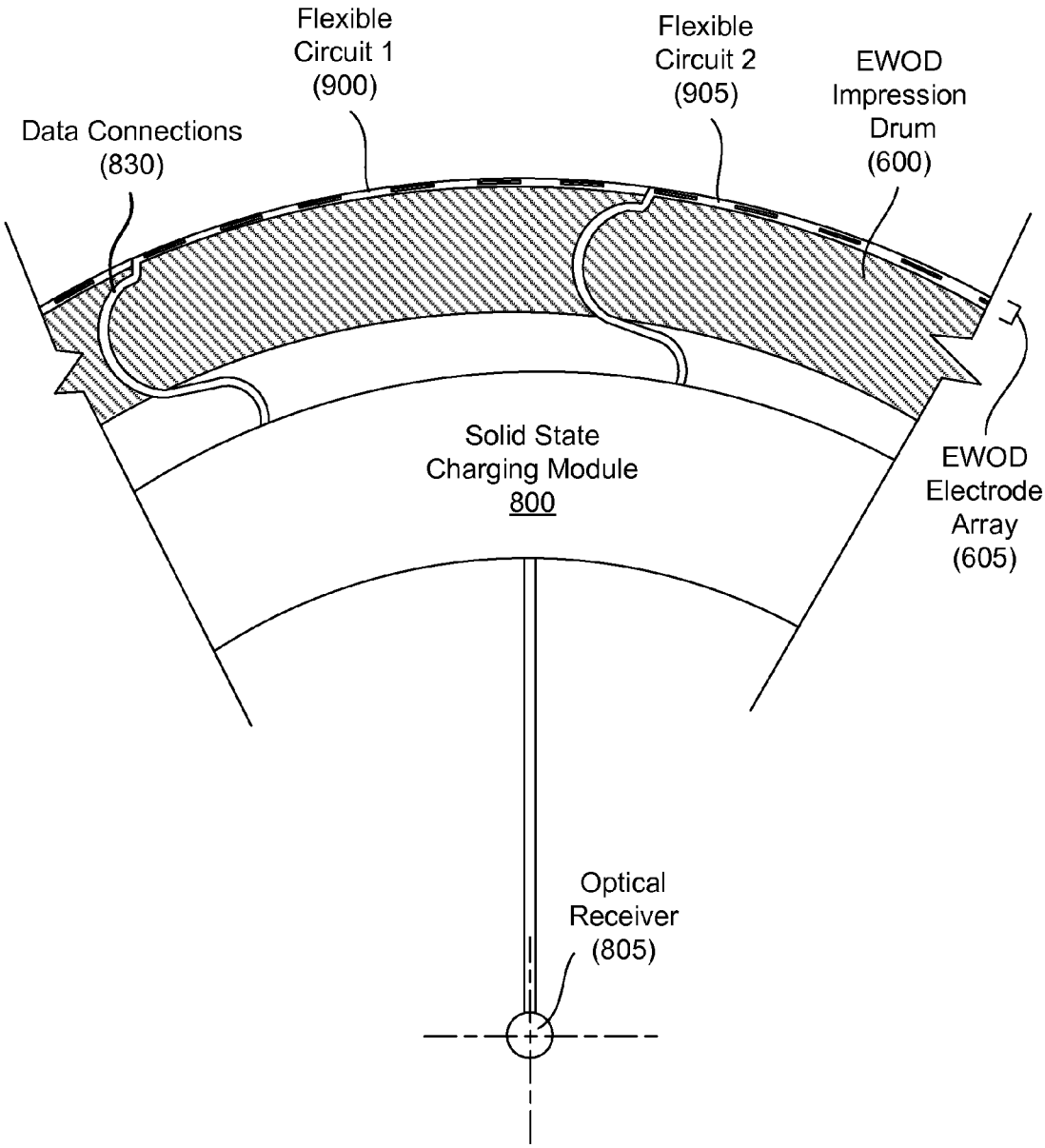
FIG. 9 is a cross-sectional end view of an EWOD impression drum, according to one illustrative embodiment of principles described herein.

FIG. 9 is a cross-sectional end view of the EWOD impression drum (600). According to one illustrative embodiment, the EWOD electrode array (605) may be comprised of multiple segments. Each segment is a flexible printed circuit (900, 905) with the appropriate electrodes and traces. The portion of the flexible printed circuit that contains the electrodes is adhered to the outer surface of the EWOD impression drum (600). The data connection (830) portion of the flexible circuit (900) passes through the drum wall and connects to the solid state charging module (800). The various flexible circuits (900, 905) are adhered to the outer surface of the drum such that there is one continuous array of electrodes over a significant portion of the impression drum (600). As discussed above, the optical receiver (805) converts the transmitted optical signals into electrical signals which are passed to the solid state charging module (800). The solid state charging module (800) uses the electrical signals to appropriately address individual electrodes. Electrical energy is passed along the data connection (830) portion of the flexible circuit (900) to the appropriate electrode.

According to one embodiment, the flexible circuit (900, 905) may be made by depositing electronic devices, traces, and electrodes on a flexible plastic substrate. According to one illustrative embodiment, the flexible plastic substrate may a polymide, polyester, KAPTON or polyetheretherketone (PEEK) film. This flexible plastic substrate is an insulator and serves to electrically isolate the electrodes as shown in FIGS. 4A and 4B. According to one illustrative embodiment, the ink-phobic coating (410, FIG. 4A) may be deposited over the flexible substrate. In an alternative embodiment, the ink-phobic coating may be directly integrated into the flexible substrate. For example, the ink-phobic coating may be used as an upper insulating surface which is sealed to a lower surface upon which the electrodes are formed. Alternatively, the insulator portion of the flex circuit (900, 905) may be made up entirely of the ink-phobic material.

The flex circuits (900, 905) may also incorporate a number of other circuits, including switching, routing, and addressing circuitry. According to one exemplary embodiment, these additional elements may be buried beneath the electrodes to minimize unintended effects on the ink-phobic surface.

Figure 10:
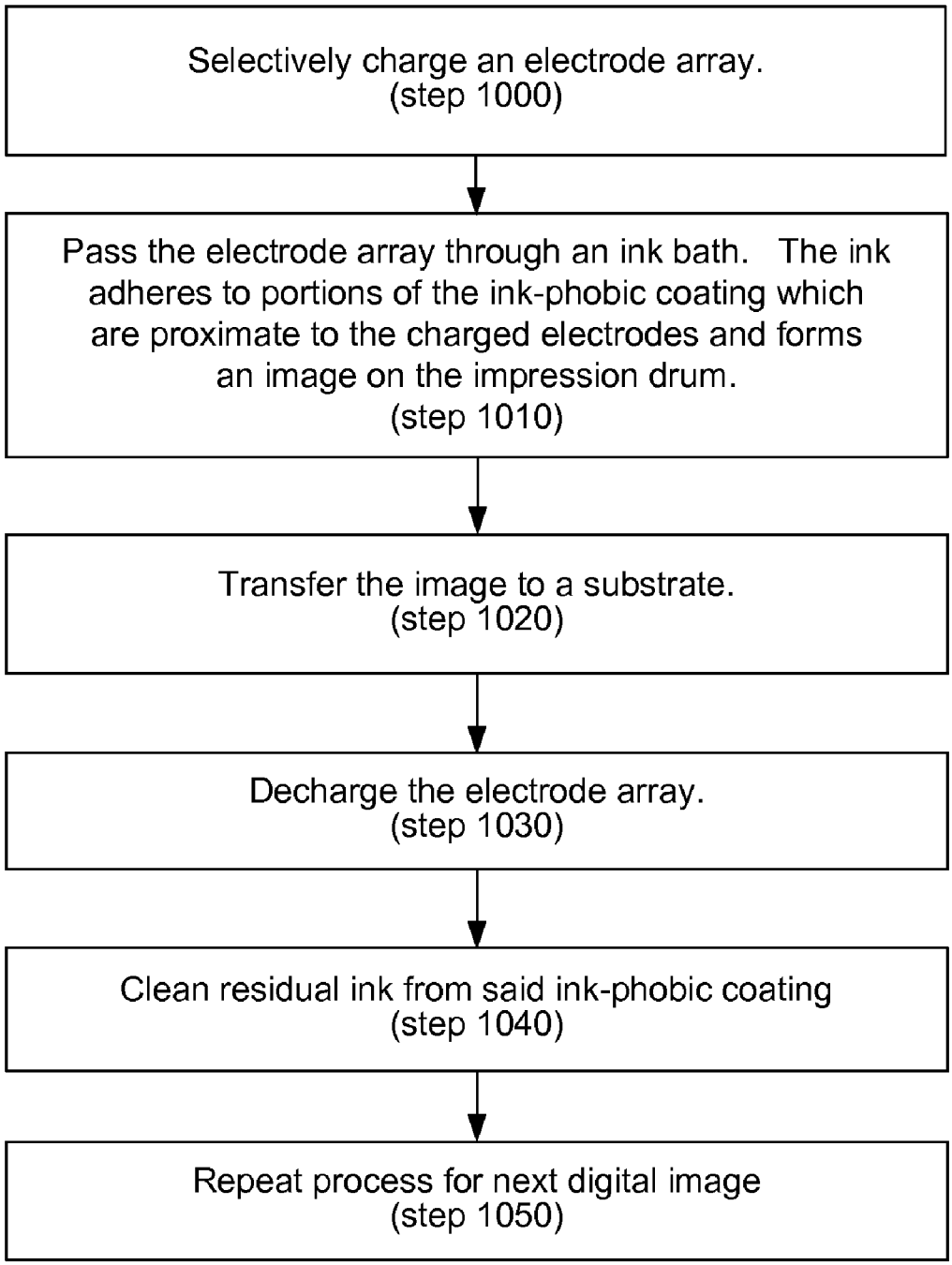
FIG. 10 is a flowchart which shows one illustrative method for using EWOD technology to enable a digital press engine, according to one illustrative embodiment of principles described herein.

FIG. 10 is a flowchart which shows one illustrative method for using EWOD technology to enable a digital press engine. In a first step, the electrode array on the outer surface of an impression drum is selectively charged by a charging module (step 1000). The electrode array is then passed through an ink bath. The ink adheres to portions of the ink-phobic coating which are proximate to the charged electrodes to form the desired image on the impression drum (step 1010). The image is then transferred to a substrate (step 1020). A decharging module then decharges the electrode array (step 1030). Residual ink is cleaned from the ink-phobic coating (step 1040) and the process is repeated for the next digital image (step 1050).

In summary, an EWOD enabled print engine provides contact printing without drop placement problems and with significantly reduced aerosol generation. The EWOD enabled print engine also provides the ability to use a wider choice of inks and simplify or eliminate drying processes. Additionally, the EWOD print engine can be configured to be drop-in replacement for existing inkjet print engines because of its inkjet-like digital architecture. For example, the EWOD print engine can utilize the existing digital front end, firm ware, and finishing apparatus of many existing inkjet printing systems.

The preceding description has been presented only to illustrate and describe embodiments and examples of the principles described. This description is not intended to be exhaustive or to limit these principles to any precise form disclosed. Modifications and variations are possible in light of the above teaching.

What is claimed is:

1. An electro-wetting-on-dielectric printing system comprising:

a drum; and an electrode array disposed on a surface of said drum, said electrode array comprising:

individually addressable electrodes; and an ink-phobic coating overlaying said electrodes, and a charging module configured to selectively charge at least a portion of said electrodes;

wherein electrically charging at least a portion of said electrodes allows ink to adhere to a portion of said ink-phobic coating in proximity to a charged electrode.

2. The system of claim 1, wherein said charging module comprises a solid state charging module.

3. The system of claim 1, wherein said charging module is stationary and has an array of contact elements, said drum rotatable such that said array of contact elements are brought into electrical contact with said electrodes, said array of contact elements being configured to be selectively energized to deposit electrical charges on said at least a portion of said electrodes.

4. The system of claim 3, wherein said array of contact elements comprise electrically conductive protrusions, said electrically conductive protrusions being configured to physical contact said electrodes.

5. The system of claim 3, wherein said array of contact elements comprises a two-dimensional array of contact elements.

6. The system of claim 2, wherein said charging module is attached to and rotatable with said drum, wherein hardwired connections are made between said electrodes and said charging module.

7. The system of claim 6, further comprising an optical transmitter and an optical receiver, said optical transmitter configured to transmit addressing data from outside said drum via optical signals to said optical receiver, said optical receiver configured to convert said optical signals into electrical signals and communicate said electrical signals to said charging module.

8. The system of claim 1, further comprising a flex circuit, said flex circuit containing said electrodes, said flex circuit being adhered to an outer surface of said drum.

9. The system of claim 1, wherein an electrical charge of an electrode is adjusted to influence at least one of: a size of ink droplet attracted to said portion of said ink-phobic coating in proximity to said electrode, adjust a contact angle of said ink on ink-phobic coating, alter a surface energy of said drum to be compatible with a transfer drum, and alter said surface energy of said drum to be compatible with a substrate.

10. The system of claim 1, wherein said ink-phobic coating comprises at least one of: fluorocarbon polymer and silicone.

11. An electro-wetting-on-dielectric printing system comprising:

a drum;

an electrode array disposed on a surface of said drum, said electrode array comprising:

individually addressable electrodes; and an ink-phobic coating overlaying said electrodes, said ink-phobic coating having one or more ink repelling characteristics, said ink-phobic coating preventing an ink from adhering to said surface of said drum;

a charging module, said charging module selectively charging at least a portion of said electrodes to counteract said ink repelling characteristics;

an ink bath, said electrode array being passed through said ink bath, wherein ink adheres to a portion of said ink-phobic coating in proximity to said at least a portion of said electrodes to form an image;

a transfer drum, said transfer drum receiving said image and transferring said image to a substrate;

a decharging module, said decharging module substantially reducing said electrical charge in said electrodes; and a cleaning station, said cleaning station removing residual ink from said ink-phobic coating.

12. A method for electro-wetting-on-dielectric printing comprising:

coating individually addressable electrodes within an electrode array with an ink-phobic coating;

selectively charging said individually addressable electrodes within said electrode array;

passing said electrode array through an ink bath, wherein ink adheres areas proximate to charged electrodes to form an image; and transferring said image onto a substrate.

13. The method of claim 12, further comprising electrically contacting said individually addressable electrodes within said electrode array through physical contact between said individually addressable electrodes and a contact element, a charging module selectively energizing said contact element.

14. The method of claim 12, further comprising decharging said individually addressable electrodes by substantially removing electrical charge from said individually addressable electrodes.

15. The method of claim 12, further comprising removing residual ink from said electrode array prior to selectively charging said individually addressable electrodes.

16. The system of claim 1, wherein a surface of said ink-phobic coating is micro-patterned to adjust its ink repellant characteristics.

17. The system of claim 1, wherein said charging module is disposed inside said drum.

18. The system of claim 2, wherein said solid state charging module is attached to and moves with said drum, said system further comprising slip rings for transferring energy to said solid state charging module.

19. The system of claim 3, wherein said contact elements extend from said charging module at a variety of angles.

* * * * *